United States Patent [19]

Price

[11] Patent Number: 4,706,959

[45] Date of Patent: Nov. 17, 1987

[54] QUARTERBACK DRAW FOOTBALL

[76] Inventor: Frank O. Price, 1712 N. Dinwiddie St., Arlington, Va. 22207

[21] Appl. No.: 850,040

[22] Filed: Apr. 10, 1986

[51] Int. Cl.[4] ..... A63F 3/00

[52] U.S. Cl. ..... 273/247; 273/274

[58] Field of Search ..... 273/244, 94, 247, 259, 273/277, 274

[56] References Cited

U.S. PATENT DOCUMENTS 4,019,737 4/1977 Witzel ..... 273/94

4,524,975 6/1985 Caughie et al. ..... 273/247

*Primary Examiner*—Richard C. Pinkham

*Assistant Examiner*—Matthew L. Schneider

*Attorney, Agent, or Firm*—Shlesinger, Arkwright & Garvey

[57] ABSTRACT

A board game for use by a plurality of players for playing a simulated football game which includes a game board having a simulated football field, a playing piece adapted to be placed on the game board for indicating the position of a player on the field, a plurality of decks of cards, each deck of cards being related to a specific type of football play, and each card having thereon the result of a selected football play. The game board is further provided with indicia representing betting areas including means for indicating different possible outcomes of a football play or a series of football plays, the game further including markers indicating a bet has been placed in the betting area on the particular outcome of a football play or a series of football plays.

5 Claims, 4 Drawing Figures

FIG 3

RECORD OF PLAYS

PLAYER $B_2$

FIELD JUDGE

64

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| 1st QUARTER | | | | | | | | | | | | | | | | | | | | | | | | | | | | | | |
| 1 | | | | | | | | | | | | | | | | | | | | | | | | | | | | | | |
| 2 | | | | | | | | | | | | | | | | | | | | | | | | | | | | | | |
| 3 | | | | | | | | | | | | | | | | | | | | | | | | | | | | | | |
| 4 | | | | | | | | | | | | | | | | | | | | | | | | | | | | | | |
| 2nd QUARTER | | | | | | | | | | | | | | | | | | | | | | | | | | | | | | |
| 1 | | | | | | | | | | | | | | | | | | | | | | | | | | | | | | |
| 2 | | | | | | | | | | | | | | | | | | | | | | | | | | | | | | |
| 3 | | | | | | | | | | | | | | | | | | | | | | | | | | | | | | |
| 4 | | | | | | | | | | | | | | | | | | | | | | | | | | | | | | |
| 3rd QUARTER | | | | | | | | | | | | | | | | | | | | | | | | | | | | | | |
| 1 | | | | | | | | | | | | | | | | | | | | | | | | | | | | | | |
| 2 | | | | | | | | | | | | | | | | | | | | | | | | | | | | | | |
| 3 | | | | | | | | | | | | | | | | | | | | | | | | | | | | | | |
| 4 | | | | | | | | | | | | | | | | | | | | | | | | | | | | | | |
| 4th QUARTER | | | | | | | | | | | | | | | | | | | | | | | | | | | | | | |
| 1 | | | | | | | | | | | | | | | | | | | | | | | | | | | | | | |
| 2 | | | | | | | | | | | | | | | | | | | | | | | | | | | | | | |
| 3 | | | | | | | | | | | | | | | | | | | | | | | | | | | | | | |
| 4 | | | | | | | | | | | | | | | | | | | | | | | | | | | | | | |
| INDIVIDUAL POINT | | | | | | | | | | | | | | | | | | | | | | | | | | | | | | |
| 1 | | | | | | | | | | | | | | | | | | | | | | | | | | | | | | |
| 2 | | | | | | | | | | | | | | | | | | | | | | | | | | | | | | |
| 3 | | | | | | | | | | | | | | | | | | | | | | | | | | | | | | |
| 4 | | | | | | | | | | | | | | | | | | | | | | | | | | | | | | |

FIG 4

GAME STATISTICS

PLAYER $A_1$

REFEREE

66

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|
| SACKS | | | | | | | | | | | | | | | | | | | | | | | | | | | | | | | |
| 1 | | | | | | | | | | | | | | | | | | | | | | | | | | | | | | | |
| 2 | | | | | | | | | | | | | | | | | | | | | | | | | | | | | | | |
| 3 | | | | | | | | | | | | | | | | | | | | | | | | | | | | | | | |
| 4 | | | | | | | | | | | | | | | | | | | | | | | | | | | | | | | |
| 1st DOWNS | | | | | | | | | | | | | | | | | | | | | | | | | | | | | | | |
| 1 | | | | | | | | | | | | | | | | | | | | | | | | | | | | | | | |
| 2 | | | | | | | | | | | | | | | | | | | | | | | | | | | | | | | |
| 3 | | | | | | | | | | | | | | | | | | | | | | | | | | | | | | | |
| 4 | | | | | | | | | | | | | | | | | | | | | | | | | | | | | | | |
| PUNTS | | | | | | | | | | | | | | | | | | | | | | | | | | | | | | | |
| 1 | | | | | | | | | | | | | | | | | | | | | | | | | | | | | | | |
| 2 | | | | | | | | | | | | | | | | | | | | | | | | | | | | | | | |
| 3 | | | | | | | | | | | | | | | | | | | | | | | | | | | | | | | |
| 4 | | | | | | | | | | | | | | | | | | | | | | | | | | | | | | | |
| FIELD GOALS | | | | | | | | | | | | | | | | | | | | | | | | | | | | | | | |
| 1 | | | | | | | | | | | | | | | | | | | | | | | | | | | | | | | |
| 2 | | | | | | | | | | | | | | | | | | | | | | | | | | | | | | | |
| 3 | | | | | | | | | | | | | | | | | | | | | | | | | | | | | | | |
| 4 | | | | | | | | | | | | | | | | | | | | | | | | | | | | | | | |
| TOUCHDOWNS | | | | | | | | | | | | | | | | | | | | | | | | | | | | | | | |
| 1 | | | | | | | | | | | | | | | | | | | | | | | | | | | | | | | |
| 2 | | | | | | | | | | | | | | | | | | | | | | | | | | | | | | | |
| 3 | | | | | | | | | | | | | | | | | | | | | | | | | | | | | | | |
| 4 | | | | | | | | | | | | | | | | | | | | | | | | | | | | | | | |

QUARTERBACK DRAW FOOTBALL

BACKGROUND OF THE INVENTION

This invention relates to a board game which simulates an actual football game wherein the players will understand what a quarterback experiences when he plays against the odds against the defense. The play includes a plurality of decks of cards, each deck of cards being related to a specific type of football play, and each card having printed thereon an indication of the result of the selected football play.

The successful playing of the game is based on playing against the odds of the cards based on skill and luck, the cards being statistically numbered so that the game may be played by young people as well as adults. The players function as quarterbacks on an individual basis, and do not need to know the complete rule book to enjoy the game. However, a player developing the knowledge of his chances of success and failure will make a better player.

In addition to playing the role of a quarterback, each player will act as a game official, i.e., referee, umpire, field judge and head linesman. A further object is to enable the players to place bets on the outcome of a football play or a series of football plays as the game proceeds.

SUMMARY OF THE INVENTION

The present invention comprises a game board which includes a simulated football field having player pieces and a line to gain marker which are moved along a simulated football field on the playing board.

Movement of the playing pieces is determined by four decks of cards which relate to the four different designations of offensive plays, namely, run, pass, punt, and field goal/extra point. The cards each contain wording indicating the result of a selected football play, and the playing pieces move in accordance with the instructions on the card.

A portion of the game board is divided into quandrants for the players, each quadrant representing a betting area on which bets may be placed for indicating different possible outcomes of a football play or a series of football plays. Markers are provided for indicating that a player has placed a bet in the betting area which are visible to all players. Additional betting areas are available on the board for placing bets on the game score and for field goal attempts.

BRIEF DESCRIPTION OF THE DRAWINGS

FIG. 3 is a plan view of a first statistical sheet for use with the football game of the present invention; and FIG. 4 is a plan view of a second statistical sheet for playing the football game of the present invention.

DETAILED DESCRIPTION OF THE PREFERRED EMBODIMENT OF THE PRESENT INVENTION

Figure 1:
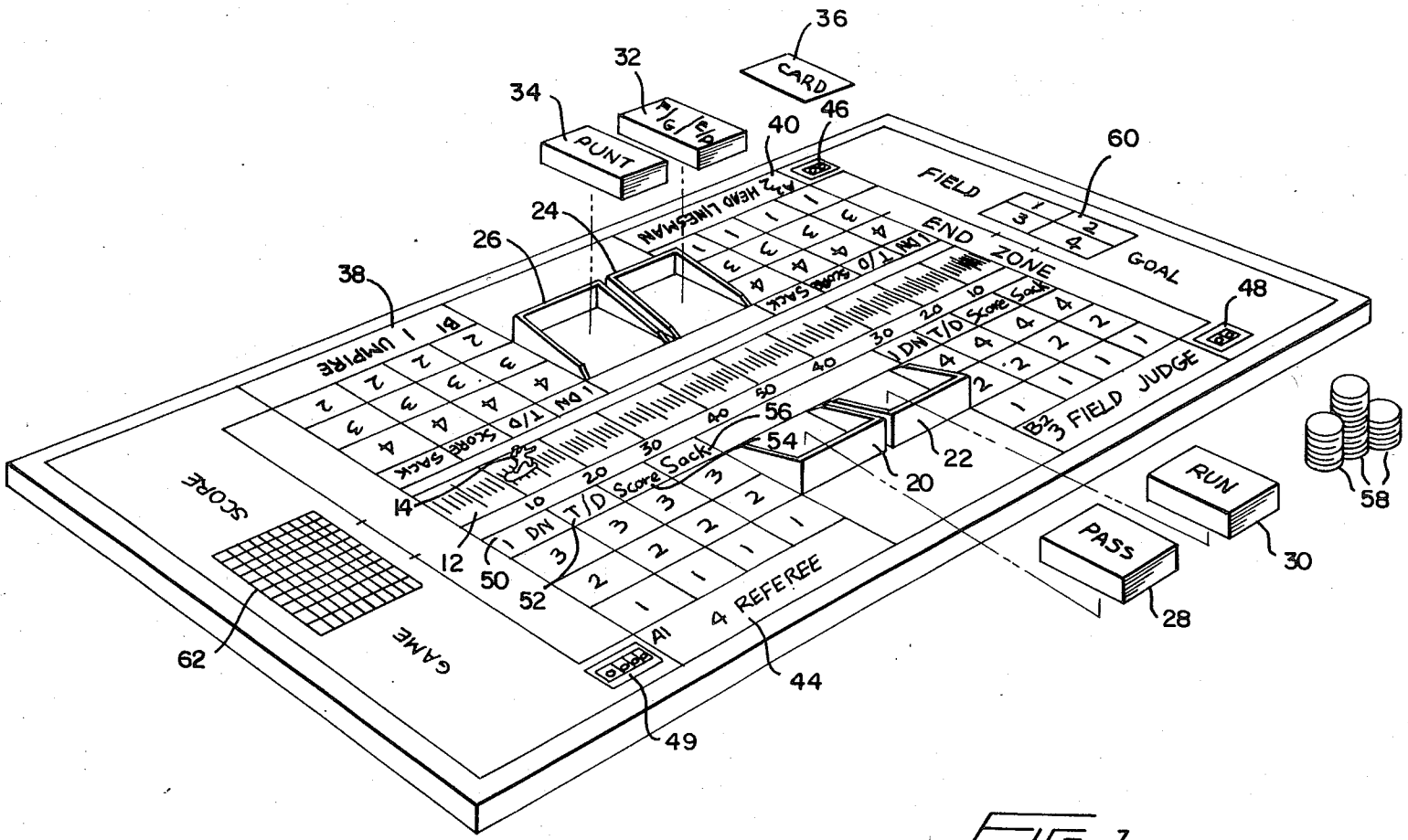
FIG. 1 is a perspective view of the football game board of the present invention.
Figure 2:
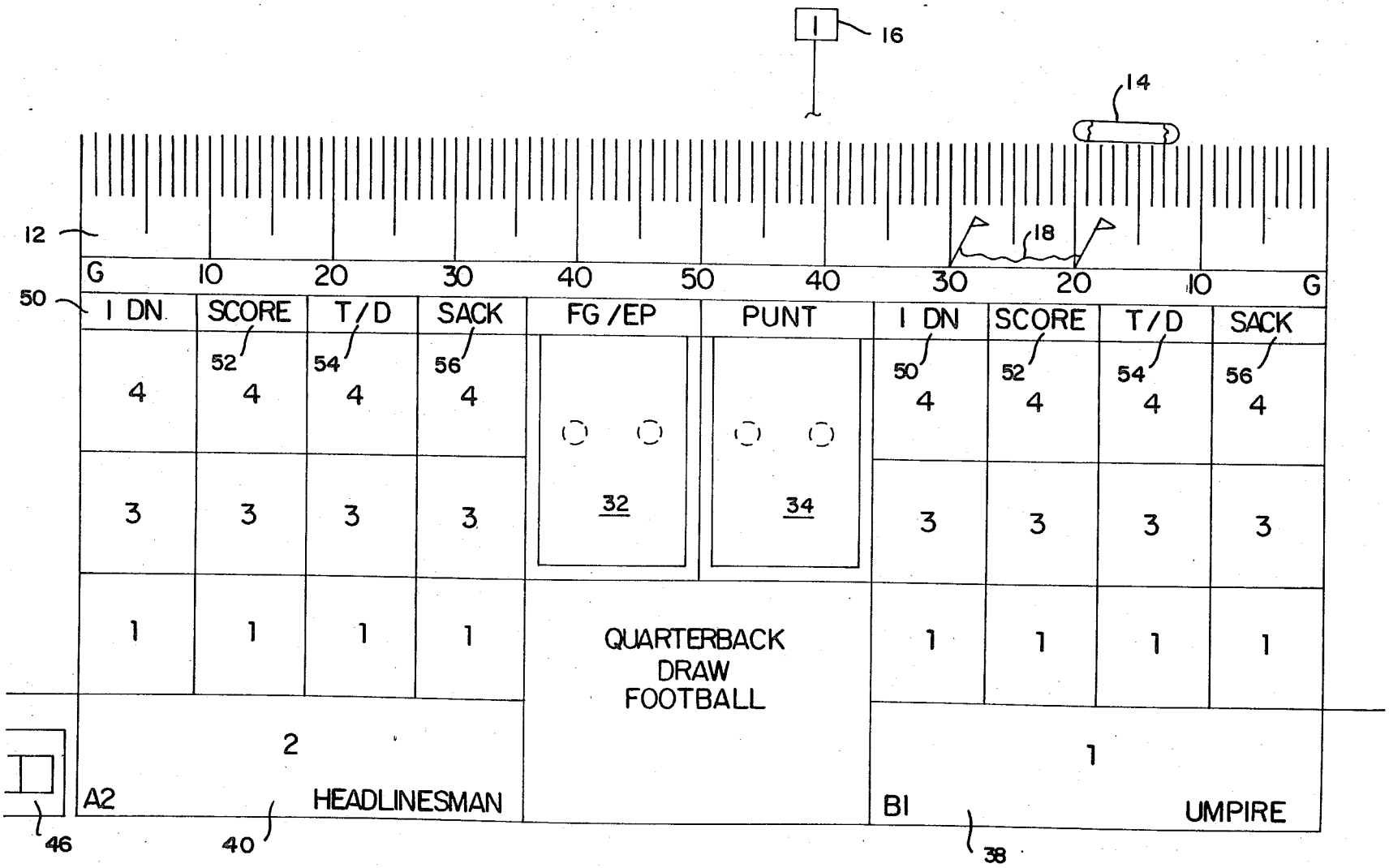
FIG. 2 is a plan view of the football game board of FIG. 1, showing details thereof.

Referring now in greater detail to the drawings, the present invention includes a game board generally designated 10 of rectangular, planar shape and made of a suitable rigid material such as cardboard. A simulated football field 12 is imprinted on the central portion of the game board and extends longitudinally thereof, the simulated football field including yard lines and yard markers. A movable game piece is indicated at 14, a down marker at 16, and a line to gain chain equipment at 18, all of which are movable on the board surface.

Adjacent both sides of the middle of the simulated football field are pairs of card holders 20, 22, 24, and 26. Holders 20, 22, 24, and 26 are adapted to receive four decks of cards representing different types of offensive football plays, deck 28 relating to pass plays, deck 30 relating to run plays, deck 32 relating to field goals and extra points, and deck 34 relating to punts.

Each of decks 28, 30, 32, and 34 preferably is comprised of 52 cards, on which are written the results of the selected football play, which cards control the movement of player piece 14 on simulated football field 12.

Although there are a variety of results of plays which may be included in each deck of cards, the following is illustrative of the wording for each deck of cards.

PASSING

There will be 52 cards in this deck as follows:

| No. of Cards | Wording on Each Card |
|---|---|
| 5 | Complete for 3 yards. |
| 5 | Complete for 5 yards. |
| 5 | Complete for 10 yards. |
| 5 | Complete for 15 yards. |
| 5 | Complete for 35 yards. |
| 3 | Complete for 40 yards. |
| 3 | Complete for 50 yards. |
| 4 | Traveled for yardage but the right offensive guard was holding. Ten yard penalty from the spot of snap. Repeat the down. |
| 4 | Attempt resulted in a sack for 5 yard loss. |
| 5 | Incomplete. |
| 3 | Defensive pass interference. First down 10 yards beyond spot of the snap. |
| 2 | Offensive pass interference. Five yard penalty and loss of down. |
| 3 | Intercepted 15 yards down field. |

RUNNING

There will be 52 cards in this deck as follows:

| No. of Cards | Wording on Each Card |
|---|---|
| 5 | Stopped. No gain on the play. |
| 12 | Gained 3 yards on this run. |
| 8 | Gained 5 yards on this run. |
| 5 | Gained 6 yards on this run. |
| 5 | Gained 7 yards on this run. |
| 3 | Gained 40 yards on this run. |
| 6 | Gained 20 yards on this run. |
| 5 | Penalized 10 yards from spot of the snap for offensive holding. Repeat the down. |
| 3 | Gained 10 yards on this run, but fumbled and lost possession of the ball. |

FIELD GOAL ATTEMPTS/EXTRA POINT ATTEMPTS

There will be 52 cards in this deck as follows:

| No. of Cards | Wording on Each Card |
|---|---|
| 6 | Attempted field goal is missed. |
| 6 | Fake attempt - ran for 2 yards. |
| 6 | Fake kick and pass incomplete. |
| 15 | Attempt traveled 30 yards. |
| 1 | Attempt traveled 50 yards |
| 5 | Attempt traveled 40 yards. |
| 7 | Attempt traveled 25 yards. |
| 6 | Attempt blocked - 5 yards lost. |

PUNTS

There will be 52 cards in this deck as follows:

| No. of Cards | Wording of Each Card |
|---|---|
| 15 | Attempt traveled 30 yards. |
| 10 | Attempt traveled 10 yards. |
| 15 | Attempt traveled 40 yards. |
| 9 | Attempt traveled 40 yards but offense was holding. Ten yard penalty from spot of the snap. |
| 2 | Attempt is short. Ball is dead 5 yards from spot of the snap. |

In addition to the four decks of cards 28, 30, 32, and 34, a regular deck of cards, indicated at 36 is initially used to determine the positions of the players on the game board and who will be the first quarterback.

The game board of the present invention further includes betting quadrants designated 38, 40, 42, and 44, which are assigned to each of the players in the game, representing players 1, 2, 3, and 4. In accordance with the present game, each player will act as a game official. Player 1 will act as umpire, and will move the player piece on the game board just as he handles the ball during a regular game situation. He will also move the player piece on penalties, long runs, etc.

Player 2, the head linesman, will manage the line to gain chain equipment 18 for keeping track of first downs. A counter is indicated at 46.

Player 3 serves as the field judge and is responsible for the official count of the number of completed plays, and informs the players of the number of plays left in the quarter. A counter is provided at 48.

Player 4 will serve as referee and is responsible for the game score and statistics, i.e., individual scoring, passing yardage, etc. He will keep any statistics for pools which are established prior to start of the game. All pools, based on statistics, must be agreed upon by each player. A counter is provided at 49.

Each of the betting areas 38, 40, 42, and 44 includes a series of vertical columns designated 50, 52, 54, and 56, the heading of each of the columns being First Down, Touchdown, Score, and Sack respectively. Under each of these columns, the "Pilo-Ero" numbering system is used. Under this system, the players own number does not appear on the numbers under each column, but only the numbers of the other players appear.

Chips 58 are placed on the numbers under each of Columns 50, 52, 54, and 56 during the game to indicate to all the players the bets which have been made.

Game board 10 further includes a field goal attempt pool betting area 60 which is located at one end of the board, and a game score betting area 62 at the opposite end of the board.

In FIG. 3 there is disclosed a first statistical sheet 64 entitled "Record of Plays" to be kept by the field judge. Sheet 64 includes a plurality of boxes on which a record is kept of all the plays of the game for each quarter and for each player. Statistical sheet 66 which is shown in FIG. 4 is kept of the Game Statistics by the referee, and records statistical information concerning sacks, first down, punts, field goals, and touchdowns by each of the players in the game.

PLAYING THE GAME

In playing the game with the game board of the present invention, players first draw from the regular deck of cards 36, the high card determining the positions on the game board of the players, and also establishes who will be the first quarterback. The second high card drawn will allow the players to choose which quadrant of the game score pool 62 they wish to choose. In this connection there may be a new drawing after each quarter, at the discretion of the players. Once the quadrants are selected, the players may elect to maintain these quadrant selections throughout the game.

Once the first quarterback has been chosen, and the quarterback is ready to draw his first play, he may be challenged on any situation on the game board, first down, score, touchdown, or sack. The player on the quarterbacks left has the first option to make a bet before the quarterback can draw his first card. That player can pass and the next player has the option. If the two other players do not place a bet, the first player to the quarterbacks left must place a minimum bet. The first quarterback will place his player piece 14 on the 20 yard line in one direction, and at this point all other alternating directions will be established. The player who begins the third quarter will place the player piece in the direction he chooses. The alternating directions are established at this point until the game is over, after the 128th play.

The terminology A1, A2, normally indicates the offensive player and B1, B2, normally indicates the defensive player. The A1, A2, B1, B2 designations are used to indicate alternating player possession in the game. The A and B can be used as team designations when playing a game that requires a team effort. The same applies to B1 and B2. In a game of "total score" A1, player 4, A2, player 2, B1, player 1, and B2, player 3, are individual players trying to score points in order to win the individual high score pool. The player designations must be this way to distinguish who starts the game and in what direction he will go.

The quarterback will also bet that his or her objective will be accomplished, the only option being the amount he will cover if he decides to bet. Minimum and maximum amounts to be bet are suggested. Some bets terminate when a series of downs end, i.e., sacks (tackle prior to passing) and first downs. Touchdown and score wagers terminate when possession is lost. It is suggested that a limit be placed on all bets based on series of downs and possession. Provisions for paying double on some game situation—losers pay double for the second sack in the same series of downs, a fifty yard field goal, and a first down score.

As a player relinquishes his position as the quarterback, the next player becomes the quarterback and will continue drawing cards until the 32nd play is completed and the field judge declares the end of the quarter. The ball's direction at this point is reversed and before the quarterback resumes playing, all bets are concluded and the quarterly pool 62 is paid out and re-established. If the quarterback is on his first, second, third, or fourth down, he will continue to draw until he loses possession.

At the half, the 64th play, the players take a break and when they return the next player in the rotation will be the quarterback to start the quarter. The game will continue just as the first half until the 128th play is completed. The game is finished when all transactions for pools are completed.

The basic concept of the game is to hold everyones attention by having someone in a position to win on each draw. At the beginning of the game each player receives a position on the game board and a player number, 1, 2, 3, or 4.

Under the "Pilo-Ero" numbering system, a player indicates he wants to place a bet and the corresponding player locates his oppositions number in his section. A quantity of chips is agreed upon and the players place the agreed amount on the oppositions number and category directly in front of him. A further observation will show that all other players numbers appear in each section. At a glance, a person can confirm the amount wagered and by whom. The winner will get his winnings from his opposition's position first, then the bets in the category where the bets terminated, leaving the other bets in place. Bets are won on almost every play to further enhance the enjoyment of the game. Other variations in playing the game are possible, such as playing the game without the use of chips on series of downs. This game is played primarily the same as set out above but geared to final game statistics. Pools can be established on the games statistics instead of a series of downs played.

It is also possible with the present game board to wage bets on an actual game being viewed on television.

While there has been herein disclosed the presently preferred form of this invention, it is to be understood that such has been done for purposes of illustration only, and that various changes may be made therein within the scope of the appended claims.

I claim:

1. A board game for use by a plurality of players for playing a simulated football game, comprising:

(a) a game board having first indicia located thereon that is representative of a football field, said first indicia including yard line and goal line indicia;

(b) a playing piece adapted to be placed on the game board for indicating the position of a player on the representative football field;

(c) a plurality of decks of cards, each deck of cards being related to a specific type of football play and each card having second indicia thereon indicating the result of a selected football play such that a player selects a particular type of football play, draws a card from the deck associated with the selected play and follows the directions set forth by the second indicia on the card;

(d) said game board having third indicia located thereon representing betting areas, said betting areas including outcomes of a football play or series of football plays; and (e) said game also including means for indicating that a player has placed a bet in the betting area whereby a player can place a bet on a particular outcome of a football play or series of football plays that be believes will occur.

2. The board game as recited in claim 1, wherein:

(a) said means for indicating that a player has placed a bet in the betting area includes a plurality of betting chips.

3. The board game as recited in claim 1, wherein:

(a) said third indicia includes a separate betting area for each player.

4. The board game of claim 3, wherein:

(a) said third indicia includes a plurality of rows and columns of spaces for placement of said means for indicating that a player has placed a bet, each column of spaces being associated with an outcome means related to a different possible outcome of a football play or series of football plays.

5. The board game of claim 4, wherein:

(a) said game board further comprises fourth indicia, a different fourth indicia being related to each of the plurality of players, said rows and columns of spaces of each player's betting area containing said fourth indicia such that each column of spaces contains a different fourth indicia related to each of the other players thereby allowing each player to bet on the outcome of a play or series of plays selected by another player.

* * * * *